United States Patent [19]

Goverde

[11] 4,053,168

[45] Oct. 11, 1977

[54] SKATE AND METHOD OF PRODUCING SAME

[75] Inventor: Ludovicus J. Goverde, Whitby, Canada

[73] Assignee: Ontario Tool Design Inc., Canada

[21] Appl. No.: 661,793

[22] Filed: Feb. 26, 1976

[30] Foreign Application Priority Data

Oct. 10, 1975 Canada ..... 241486

[51] Int. Cl.[2] ..... A63C 1/22

[52] U.S. Cl. ..... 280/11.12; 264/328

[58] Field of Search ..... 280/11.17, 11.12, 11.18, 280/11.16, 11.14, 11.15, 11.1 R; 264/23, 328; 156/73.1, 73.2, 73.3, 73.4, 380

[56] References Cited

U.S. PATENT DOCUMENTS

| | | | |
|---|---|---|---|
| 1,405,981 | 2/1922 | Drevitson | 280/11.17 |
| 3,212,786 | 10/1965 | Florjancic et al. | 280/11.12 |
| 3,623,926 | 11/1971 | Sager | 156/73.1 |
| 3,934,892 | 1/1976 | Baikie | 280/11.12 |

FOREIGN PATENT DOCUMENTS

| | | | |
|---|---|---|---|
| 697,856 | 11/1964 | Canada | 280/11.17 |
| 585,720 | 10/1959 | Canada | 280/11.17 |

*Primary Examiner*—Joseph F. Peters, Jr.
*Assistant Examiner*—Milton L. Smith
*Attorney, Agent, or Firm*—Cushman, Darby & Cushman

[57] ABSTRACT

An ice skate of the "plastic" type is produced by separately molding two halves of the upper portion of the skate, by subsequently introducing between the two halves a steel runner and by welding the two halves together to form a unitary plastic upper portion of the skate. The advance over prior art of "plastic" skates is in avoiding internal stress of the plastic section of the skate due to internal stress developed in known "plastic" skates due to the shrinkage of the plastic material. The molds for producing the two halves are considerably less expensive than those required in the production of known, single-piece plastic skates. One of the "halves" of the plastic upper portion comprises at least one generally complete supporting column section provided with a flange for securing the skate to a skating boot.

5 Claims, 17 Drawing Figures

SKATE AND METHOD OF PRODUCING SAME

The present invention relates to a method of producing an ice skate of the type having a generally unitary plastic upper portion in which is embedded a metallic runner blade.

The presently used steel or metallic skates are assembled and welded together from approximately 20 different parts for the left and for the right skate. Not only is the production of such skate relatively expensive but the all metal skate also poses a problem from the standpoint of corrosion of its different parts.

Attempts have been made to produce so-called plastic skates, which are characterized by a metallic runner blade embedded in a unitary thermoplastic top. The reason for attempts to produce a plastic skate is in obvious advantages of such a skate, such as lower cost of manufacture, substantially smaller number of parts, low weight of the skate, reduced problems with respect to corrosion and also an improved thermal insulation due to a low thermal conductivity of the plastic portion of such skate.

A typical example of a plastic skate is described in Canadian Pat. No. 697,856 issued to Florjancic and Schmidt on Nov. 17, 1964. The plastic skates are characterized by a unitary upper portion which includes a section, in which the steel runner blade is embedded, together with supporting columns the upper flange portions of which are used in securing the skate to a boot. The known skates of this type are produced by injection molding in a special type of mold into which the steel runner blade is first positioned. The mold is then closed and suitable plastic material injected into same.

Although the plastic skates proposed hereinbefore generally meet the above listed requirements, they still suffer from the considerable drawbacks due to which the plastic skates are still far from enjoying commercial success. The presently known plastic skates fall far from meeting the basic requirements as to the strength of a skate. This is due to the stress to which the plastic portion of the skate is subjected due to uneven thermal shrinking of the plastic portion with respect to the steel runner blade. The stress developing within the skate gives rise to cracks in the plastic material once the skate is subjected to impact forces. The impact forces, of course, are unavoidable during the use of the skate. Another drawback of the plastic skate known in the art is that it requires a very complex mold and that the inserting of the runner in the mold substantially increases the period of the molding cycle.

Due to the above drawbacks, the plastic skates proposed in different prior patents have never really reached the state of the production on a commercial scale.

It is an object of the present invention to overcome the above drawbacks of the known plastic skates and to provide a skate that would be relatively inexpensive to manufacture and, on the other hand, would have a substantially increased overall strength in comparison with the known types of plastic skates.

According to the invention, a method is provided for producing an ice skate of the type having a plastic upper portion including two flange portions for securing the skate to a boot, and a metallic runner embedded in a base section of the upper portion, with a lower section of said runner protruding downwardly along the lower or bottom face of the base section. The method comprises the steps of producing, by injection molding, two separate halves of said upper portion from a plastic material and allowing both said halves to cool down at regular shrinkage. The runner blade is then located between the two separate halves in a suitably shaped recess provided in the base section of at least one of the halves. The two halves are then pressed together and fixedly secured to each other along a joint extending generally longitudinally with respect to the runner, to produce a generally unitary plastic upper portion, which, in overall appearance, is similar to the known plastic upper portion of plastic skates. The securing of the two halves together is preferably effected by ultrasonic welding.

The above method thus results in a new and useful ice skate of the type having a plastic, generally unitary upper portion including two flange portions for securing the skate to a boot, and a metallic runner embedded in a base section of the upper portion, with a lower section of the runner protruding downwardly along the lower section of the base section, wherein the plastic, generally unitary upper portion comprises two halves each of which is produced by injection molding, with the runner located between such two halves. The two halves are fixedly secured to each other along a joint extending generally longitudinally with respect to said runner, the joint being preferably an ultrasonic weld. It will be appreciated that the term "generally unitary"as referred to in the context of this invention may also be interpreted as "consisting of two halves fixedly secured to each other, preferably by ultrasonic welding".

The invention will now be described with reference to the accompanying drawings.

Figure 1:
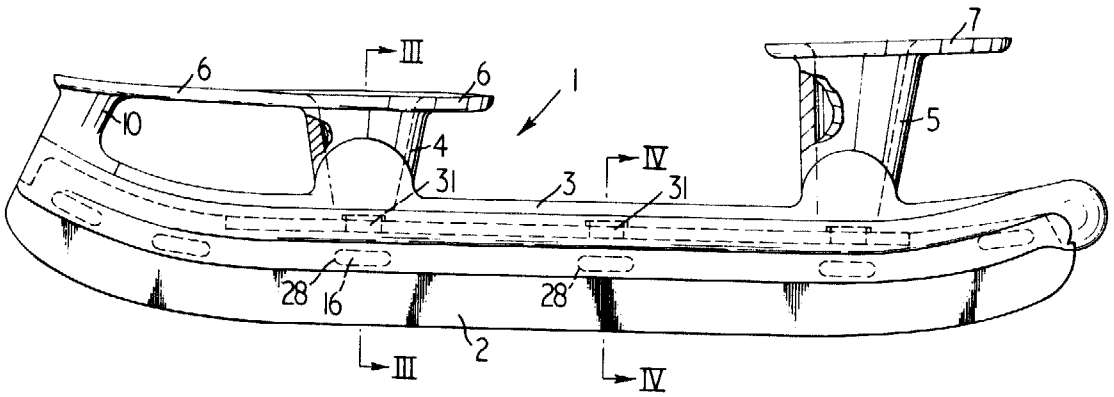
FIG. 1 is a schematic side view of a right hockey skate according to the invention, it being understood that the left hockey skate according to the present invention corresponds exactly to that shown in FIG. 1 but being a mirror image of same.

Turning firstly to FIG. 1, it will be seen that a hockey skate is shown which generally consists of a plastic upper portion 1 in which is embedded an elongated runner 2. The upper portion 1 is made of a mixture of nylon and glass fiber, containing approximately 70% of nylon and 30% glass fiber (by volume). The upper portion 1 consists of a generally horizontally extending base section 3 from which protrude upwardly two generally frusto-conical columns 4, 5, the top portions of columns 4 and 5 merging into generally horizontal flanges 6, 7 provided with bores 8, 9 for fixedly securing the skate to a skating boot (not shown). The forward or tip portion of flange 6 merges into a reinforcement strip 10 extending between the tip of flange 6 and the forwardmost end of the base section 3.

Figure 2:
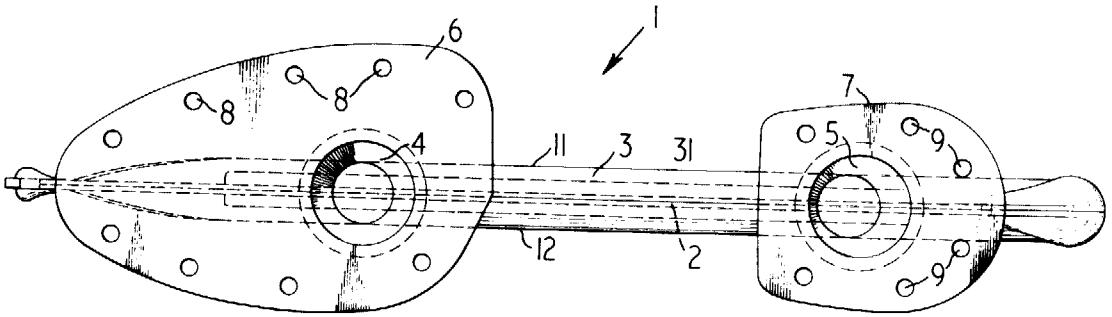
FIG. 2 is a top view of FIG. 1.

The upper portion 1 consists of two separate halves joined together by ultrasonic welding. The two halves are designated as a right half 11 (FIG. 2) and a left half 12.

Figure 5:
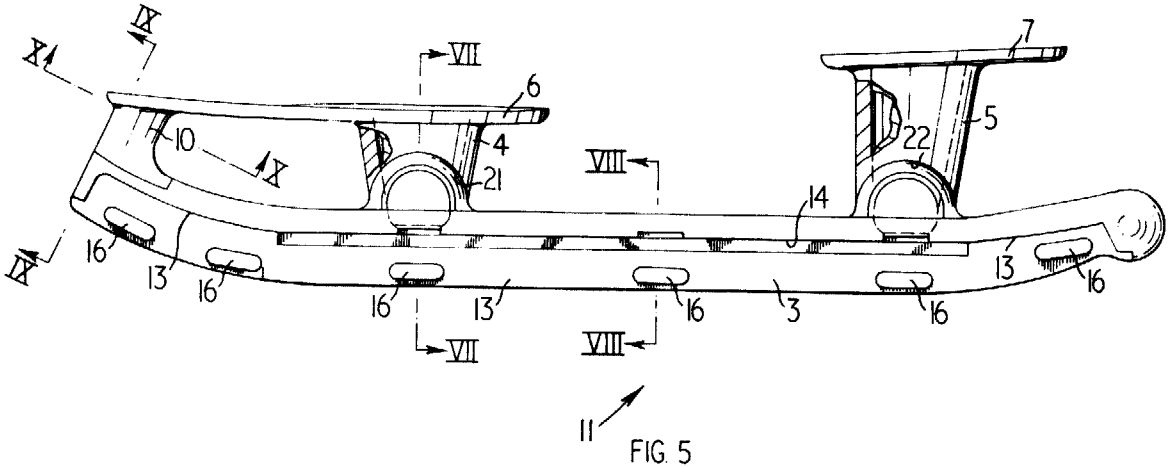
FIG. 5 is a side view of the right half of the plastic upper portion of the skate of FIG. 2.
Figure 8:
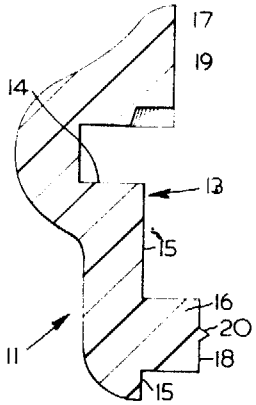
FIG. 8 is section VIII—VIII of FIG. 5.

The right half 11 (FIG. 5) has a base section which, eventually, forms a portion of the base section 3 of the entire skate and is therefore referred to with the same reference numeral in FIG. 5. Extending along the bottom portion of the base section 3 is a recess or depression 13, the shape of which can be best understood by comparison of FIG. 5 and the section of FIG. 8. It will be observed that the depression 13 consists of several portions. In the upper part of FIG. 8, it can be seen that the depression 13 includes a relatively deep upper recess 14 and a relatively shallow central and bottom portion 15. Protruding sidewise and forwardly of the portion 15, as viewed in FIG. 5, is a plurality of lugs 16, the upper and the lower surfaces of each of the lugs extending in a generally horizontal direction. It will be observed that surfaces 17, 18 of the right half 11 (FIG. 8) which, eventually, become fixedly secured to the other half, are provided with tiny protrusions 19, 20 of a generally triangular cross-section, the protrusions 19 and 20 being unitary with the entire right half 11 and assisting in the ultimate joining of the two halves together, as described hereinafter.

Figure 7:
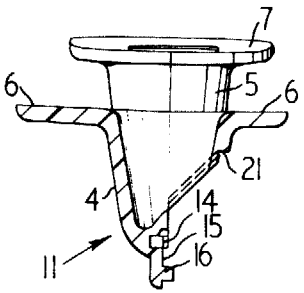
FIG. 7 is section VII—VII of FIG. 5.
Figure 6:
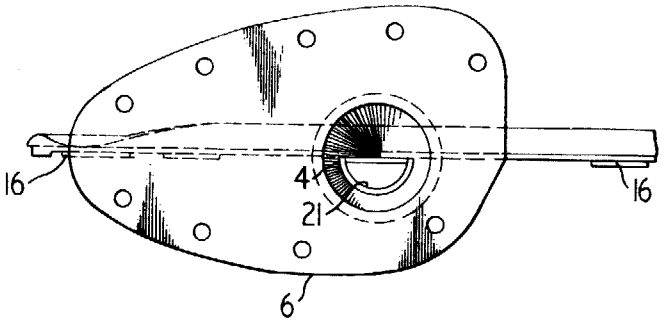
FIG. 6 is a partial top view of the front part of the upper portion shown in FIG. 5.
Figure 10:
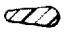
FIG. 10 is section X—X of FIG. 5.
Figure 9:
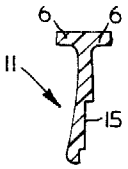
FIG. 9 is section IX—IX of FIG. 5.

Turning now back to FIG. 5, it will be observed that the right half 11 is unitary with substantial portions of the columns 4 and 5 and that the flanges 6, 7, together with the strip 10 are also unitary with the right half 11. Each of the columns 4, 5 of the right half 11 has, at the base section 3, an upwardly arched cut-out 21, 22. The shape of the arched peripheral edge of the cut-out 21 or 22 can be appreciated from the section view of FIG. 7. The arcuate portion of the cut-out 21 is step-shaped in cross-section to receive and center the matching part of the left half 12 which will be described hereinafter.

The columns 4, 5 are hollow and thus of a generally annular cross-section.

Figure 11:
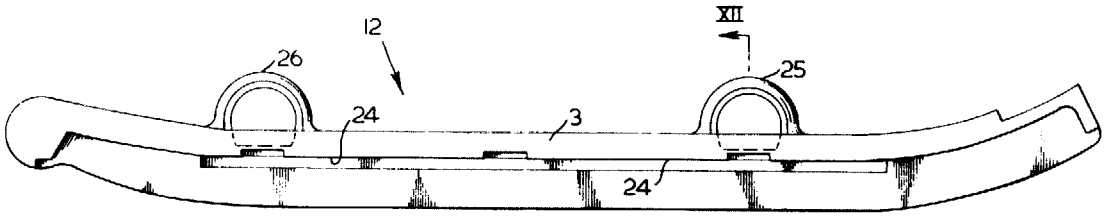
FIG. 11 is a side view of the left half of the plastic upper portion of FIG. 2.
Figure 12:
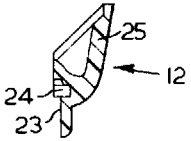
FIG. 12 is section XII—XII of FIG. 11.
Figure 13:
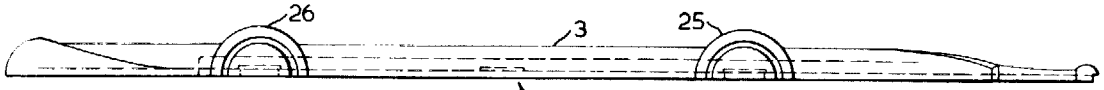
FIG. 13 is a top view of FIG. 11.

Turning now to FIG. 11, it will be seen that the left half 12 of the upper portion 1 also includes a base section 3 extending in longitudinal direction and having therein a relatively shallow depression 23 (FIG. 12) with a relatively deep, horizontally extending recess 24.

The left half 12, however, differs rather substantially from its counter-half 11 in that the left half 12 only contains relatively low, generally semi-circular protrusions 25, 26, the peripheral portion of each of the protrusions 25, 26 being upwardly arched and (FIG. 12) being step-shaped to match the edge of the semi-circular cut-outs 21, 22 in the column portions of the right half 11. It will be observed that the depression 23 of the left half 12 is flat, although it would be within the scope of the present invention to provide such depression with openings for receiving the lugs 16 of the right half 11.

As regards the recess 24 in the left half 12 and the recess 14 in the right half 11, and referring to FIG. 11 and FIG. 5, it will be observed that the overall length of such recess is less than the overall length of the base section 3 and that the recess extends in a generally straight, horizontal direction.

Figure 4:
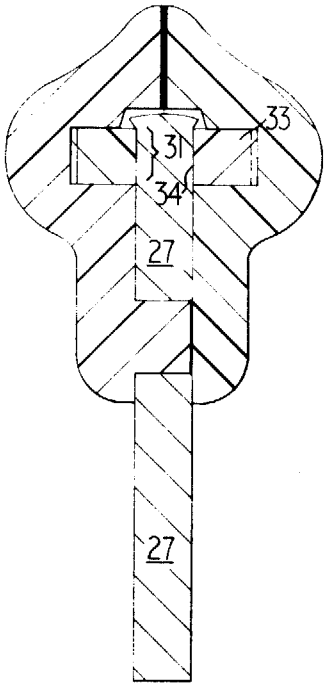
FIG. 4 is an enlarged section IV—IV of FIG. 1.
Figure 3:
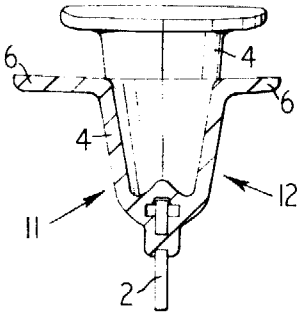
FIG. 3 is section III—III of FIG. 1.
Figure 14:
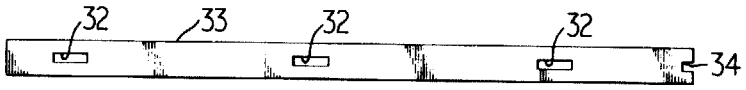
FIG. 14 is a top view of a web for use with the runner of the skate.
Figure 15:
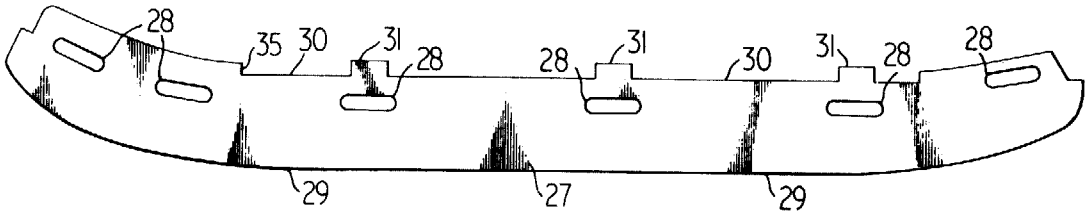
FIG. 15 is a side view of the runner.

The depressions 13, 23 and the recesses 14, 24 are arranged for receiving, in a tight-fit fashion, the assembly of the runner 2 which will be described in greater detail with reference to FIGS. 14 and 15. In general, the runner 2 consists of a runner blade 27 (FIG. 15) which is produced from a flat piece of steel and which has a plurality of generally horizontally elongated holes 28. The outer edge 29 of the runner blade 27 is curved in the front and in the back portion of runner 2, to conform with the usual shape of the runner edge of a skate. The central upper portion or edge 30 of the runner blade 27 is provided with three lugs 31 which are unitary with the remainder of the blade 27 and the purpose of which is to engage rectangular openings 32 (FIG. 14) of a steel web 33. The front edge of the steel web 33 is provided with a rectangular cut-out 34 (FIG. 14) adapted to engage a forward shoulder 35 (FIG. 15) of the runner blade 27. The height of the lugs 31 is greater than the overall thickness of the steel web 33 to allow the upper end of each of the lugs 31 to protrude above the top level of the web 33. The protruding top portion of webs 31 is used in riveting the web 33 to the blade 27, as best seen in FIG. 4.

It will thus be seen that the assembly of runner 2 is produced by riveting the steel web 33 to the runner blade 27. As best seen from FIG. 4, the combined width of the recesses 14, 24 in the halves 11, 12 is such that a cavity is provided to receive the sides of the web 33 in a tight-fit fashion.

In carrying out the manufacture of the skate of the present invention, the halves 11, 12 are produced by injection molding from a mixture of nylon and glass fiber containing approximately 70% of nylon and approximately 30% of glass fiber. The mixture is heated to approximately 290° C. before entering the mold cavity, the molten mixture entering the mold at a pressure of approximately 20,000 p.s.i.

The runner is made from high carbon steel number SA1065 and hardened to a Rockwell C. of 59 -60. The runner blade 27 and the steel web 33 are stamped in two separate stamping dies, then riveted together and finally hardened as described above. Eventually, the T-shaped runner is ground to the appropriate thickness before assembling the skate.

The assembling of the skate is effected by placing the runner 2 onto the lugs 16 with one side of the steel web 33 entering the recess 14 of the right half 11 (FIG. 4). The left half 12 is then pressed against the right half 11, whereby the opposite side of the steel web 33 enters the recess 24 of the left half 12. At the same time, protrusions 19, 20 of the left half 12 enter the corresponding cut-outs 21, 22 of the right half. The assembled halves are now ready for ultrasonic welding of the joinder between the same. Ultrasonic welding of plastic materials is well known in the art; it is, basically, a mechanical process for the joining of solids by the effect of high-frequency vibrations. In general, high-frequency current (electronic energy) generated in a HF-generator is converted to "ultrasonic vibrations" by a vibration transducer and such transducer is connected to a vibration conductor which transfers the vibrations to the material to be welded. The welding mechanism of this particular method has not yet been studied in all details but it is assumed that the heat generated during this method is built up essentially by friction among the molecules and friction of the surfaces of the two parts being welded together. Thus, ultrasonic welding is comparable to frictional welding with the difference being that the former involves only small reciprocal movements in the welding area.

The welding results in securing of the halves 11, 12 to each other along a weld which, basically, extends (FIG. 1) from the rearmost end of the base of the skate, continues along the upper edge thereof as far as the rear column 5, then follows the arcuate path of the joinder between the cut-out 22 and its associated protrusion 25, further along the top of the horizontal section of the base 3, toward the joinder between cut-out 21 of column 4 and its associated protrusion 26 and then toward the reinforcement strip 10, along the top edge of base 3 between column 4 and the strip 10, and, finally, along the forwardly and downwardly sloping front edge of the reinforcement strip 10.

It has been found that by producing the skate as described hereinabove, the product is free of undesired stresses which is one of the reasons preventing the prior plastic skates from the actual entering of the market. The weld joining the two halves renders the upper portion 1 of the skate generally unitary, as in the case of prior art plastic skates. Due to the horizontal arrangement of the steel web 33 and also due to the lugs, both of which fit in a tight-fit fashion into their respective counterparts, the transmission of the skater's weight within the plastic base section 3 is effected, without subjecting the base 3 to any undue stress. Moreover, due to the columns 4, 5 being substantially unitary with only one of the two halves of the skate, such columns are very strong and thus further contribute to the overall performance of the skate, which is superior to any known type of plastic skates.

Figure 16:
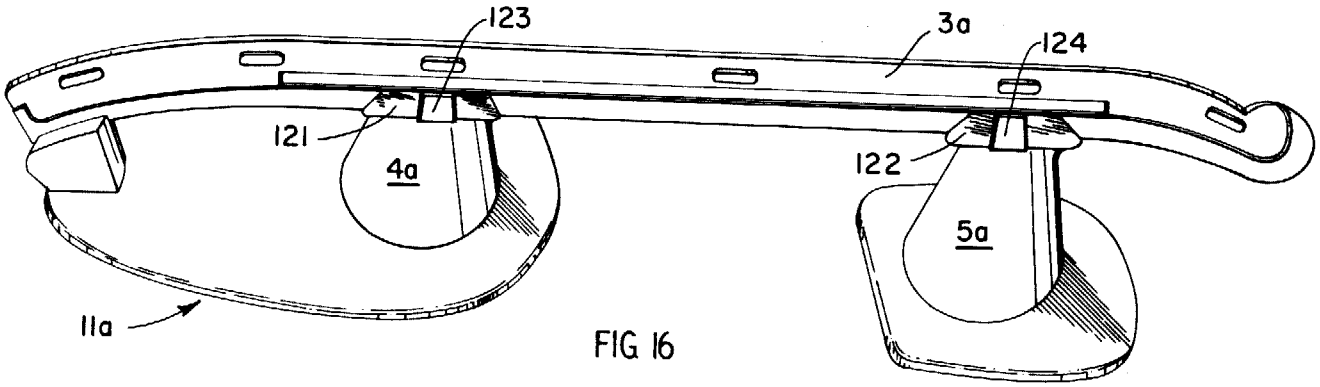
FIGS. 16 and 17 are perspective views of another embodiment of the halves as shown in FIGS. 5 and 11, respectively.
Figure 17:
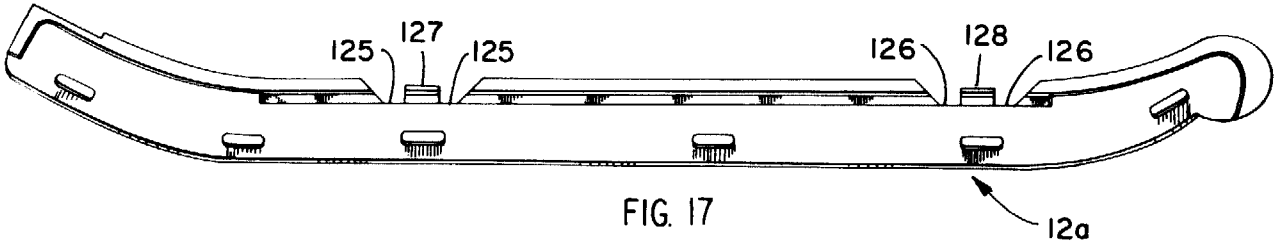

Turning now to FIG. 16 and FIG. 17, it will be seen that the two perspective views show a modified embodiment of the present invention. On comparing FIG. 16 with FIG. 5 it will be seen that a right half **11*a* is shown which has a base section 3*a* and a recess or depression 13*a*, a relatively deep upper recess 14*a* and a plurality of lugs 16*a*, corresponding to the parts 3, 13, 14 and 16, respectively, of FIG. 5**.

The embodiment of FIG. 16, however, differs substantially from the half 11 of FIG. 5 in the shape of the joinder between the two halves in the area of columns **4*a*, 5*a*. It will be seen that the upwardly arched cut-out 21, 22 of FIG. 5 is not present in FIG. 16. Instead, the bottom of each of the columns 4*a*, 5*a* shows flat, generally horizontal surfaces 121, 122 with a centrally located cut-out 123, 124. The surfaces 121, 122 are arranged to match with the surfaces 125, 126 of the left half 12*a* (FIG. 17), while the corresponding protruding tongues 127, 128 correspond in shape to the recesses 123, 124. It will thus be seen that this particular embodiment no longer is provided with the arcuate joinders 21, 22 shown in FIG. 5. It has been found that the embodiment of FIGS. 16, 17 is particularly advantageous from the standpoint of manufacture. The remaining portion of both halves 11*a*, 12*a* of FIGS. 16, 17 substantially correspond to their counterparts shown in FIGS. 1 - 13 and can be used with the blade assembly as shown in FIGS. 14 and 15**.

It will thus be appreciated that the present invention results in a plastic skate which meets the requirements of an actual use of a skate, at the same time reducing the overall cost of manufacture by avoiding expensive and relatively complex molds necessary for the production of known plastic skates.

Those skilled in the art will readily conceive embodiments which may differ from the examples shown above. The same applies to the mixture used in the method according to the present invention, the mixture itself not being novel. Similarly, the shape of the joinder of the two halves in the column regions may be different from those shown, as best seen by comparing the embodiment of FIGS. 1 - 13 with that of FIGS. 16 and 17. These and many other modifications, however, do not depart from the scope of the present invention as defined in the accompany claims.

The embodiments of the invention in which an exclusive property or privilege is claimed are defined as follows:

1. An ice skate of the type having a plastic, generally unitary upper portion including a base section and two flange portions for securing the skate to a boot, and a metallic runner embedded in a lower section of said upper portion with a lower section of said runner protruding downwardly along said base section wherein said plastic, generally unitary upper portion comprises two uneven halves, said runner being located between the base sections of said two halves, said two halves being fixedly secured to each other along a joint extending generally longitudinally with respect to said runner, wherein one of said halves is an integral part including at least one complete flange portion and a substantial portion of a supporting column section associated with said at least one complete flange portion.

2. An ice skate as claimed in claim 1, wherein the top portion of said runner includes a longitudinally extending horizontal web portion fixedly secured to said runner to form a generally unitary portion thereof, each of said halves including recesses receiving an associated portion of said web in a tight-fit fashion.

3. An ice skate as claimed in claim 1, wherein said runner is provided with a plurality of holes extending transversely of the thickness of the runner and receiving plastic lugs in a tight-fit fashion, each of said lugs being unitary with one of said two halves.

4. An ice skate as claimed in claim 1, wherein said one of said halves is a unitary part including both of said flange portions and a substantial portion of the supporting column sections of the respective flange portion.

5. An ice skate as claimed in claim 1, wherein said column section of said one half is cut-out at one side thereof near the lower end of same to produce openings in one side of each of the associated column portions at the lower end thereof, said opening being each adapted to receive a correspondingly shaped section of the other half, to produce a joinder between said two halves, said joinder being a part of said joint, whereby a portion of said joint associated with the column portion diverts from said generally longitudinal direction of the remaining portions of the joint, to follow a locus coincident with said joinder.

* * * * *